US006639556B2

(12) United States Patent
Baba

(10) Patent No.: US 6,639,556 B2
(45) Date of Patent: Oct. 28, 2003

(54) PLANE PATCH ANTENNA THROUGH WHICH DESIRED RESONANCE FREQUENCY CAN BE OBTAINED WITH STABILITY

(75) Inventor: Toshiki Baba, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/972,357

(22) Filed: Oct. 5, 2001

(65) Prior Publication Data

US 2002/0041255 A1 Apr. 11, 2002

(30) Foreign Application Priority Data

Oct. 10, 2000 (JP) ..... 2000-309721

(51) Int. Cl.[7] ..... H01Q 13/26
(52) U.S. Cl. ..... 343/700 MS; 343/770
(58) Field of Search ..... 343/700 MS, 785, 343/846, 848, 849, 770, 767

(56) References Cited

U.S. PATENT DOCUMENTS 4,689,629 A * 8/1987 Traut et al. ..... 343/770
6,225,958 B1 5/2001 Amano et al. ..... 343/700 MS
6,362,786 B1 * 3/2002 Asano et al. ..... 343/700 MS

FOREIGN PATENT DOCUMENTS

JP Hei 09-153717 6/1997

* cited by examiner

*Primary Examiner*—James Clinger
(74) *Attorney, Agent, or Firm*—Brinks Hofer Gilson & Lione

(57) ABSTRACT

A plane patch antenna has a dielectric substrate formed by calcining ceramic powder press-molded in a desired shape. On one surface of the dielectric substrate, a concave groove is continuously formed along the inside of its outer edge, and on an entire surface within a region partitioned by this concave groove, a patch electrode is thick-film printed.

22 Claims, 3 Drawing Sheets

PLANE PATCH ANTENNA THROUGH WHICH DESIRED RESONANCE FREQUENCY CAN BE OBTAINED WITH STABILITY

BACKGROUND OF THE INVENTION

1. Field of the Invention

The present invention relates to a preferred plane patch antenna to be used as a GPS (Global Positioning System) antenna or the like.

2. Description of the Prior Art

In recent years, the GPS antenna is incorporated in a portable apparatus, whereby movement to constitute a portable type navigation system or to utilize it in order to acquire positional information in emergency communication between portable telephones has become active, and accordingly, a very small-sized plane patch antenna has been developed.

FIG. 5 is a perspective view showing a conventionally known plane patch antenna, and FIG. 6 is a cross-sectional view showing the plane patch antenna. As shown in these views, the conventional plane patch antenna is structured such that on one surface of a square dielectric substrate 10, there is formed a patch electrode 11, and over the other surface, there is formed a ground electrode 12. The patch electrode 11 is formed with a cutout 11*a* as a degenerated separate element, and in the location at some distance from the center, there is formed a feeding point 13. The structure is arranged such that power is supplied to this feeding point 13 from the ground electrode 12 through a coaxial cable 14.

In a plane patch antenna structured as described above, for the dielectric substrate 10, a ceramic material having a high dielectric constant $\epsilon r$ is generally used, and ceramic powder obtained by press molding is calcined at a desired temperature (about 1300° C.), whereby the dielectric substrate 10 can be obtained. Also, the patch electrode 11 consists of a conductive layer of Ag or the like, which has been thick-film formed on one surface of the dielectric substrate 10 after calcination. Concretely, Ag paste of a desired shape is formed on one surface of the dielectric substrate 10 after calcination by means of screen printing, and this Ag paste is calcined at a desired temperature (about 800° C.), whereby the patch electrode 11 can be formed.

In such a plane patch antenna, it has been known that its resonance frequency depends to a large degree on variations in dimension of the patch electrode 11 and variations in dielectric constant of the dielectric substrate 10, and as shown in FIG. 7, when a length L of one side of the patch electrode 11 becomes larger, the resonance frequency fr decreases, and as shown in FIG. 8, when the dielectric constant $\epsilon r$ of the dielectric substrate 10 becomes higher, the resonance frequency fr decreases. Therefore, to minimize these variations is very important in order to stabilize the resonance frequency. Since the dielectric substrate 10 after the calcination changes in dimension, caused by variations in particle diameter of ceramic powder, calcination temperature conditions and the like, it is difficult to restrict variations in the dielectric constant of the dielectric substrate 10. Also, since mask deviation, drips of printing and the like are feared during screen printing, it also becomes difficult to restrict variations in dimension of the patch electrode 11.

Thus, in the conventional technique described above, for example, the resonance frequency has been adjusted by cutting the patch electrode 11 before shipped as the product, but since the variations in dimension of the patch electrode 11 occur not only in the length of one side, but also in a cutout 11*a*, which is a degenerated separate element, when an attempt is made to adjust the resonance frequency, a circularly polarized wave generating frequency and its axial ratio will be changed, and as a result, this has led to a problem that the yield as the product would be reduced.

SUMMARY OF THE INVENTION

The present invention has been achieved in the light of the state of affairs of the prior art, and is aimed to provide a plane patch antenna through which a desired resonance frequency can be obtained with stability without requiring any troublesome frequency adjusting operation.

The present invention has been achieved by focusing attention to the fact that the variation in dimension of the dielectric substrate after calcination and the dielectric constant are in inverse proportion. According to the present invention, there is provided a plane patch antenna, in which on one surface of a dielectric substrate, there is formed a patch electrode while over the other surface the dielectric substrate, there is formed a ground electrode, wherein on the one surface of the dielectric substrate, there is formed a region partitioned through its outer edge and a difference in level, and on an entire surface of this region, the patch electrode is thick-film printed.

In the plane patch antenna structured as described above, an area of the patch electrode depends upon processing precision of a step formed on one surface of the dielectric substrate in advance, and an area of a region partitioned by this step varies with a size of the dielectric substrate after calcination. Here, the size of the dielectric substrate after calcination varies with conditions of calcination and coupling among dielectric particles, and since the degree of shrinkage is increased as the particle diameter is smaller and the calcination and coupling become closer, the outside shape of the dielectric substrate becomes smaller and the dielectric constant becomes higher. More specifically, when the outside shape of the dielectric substrate after calcination is small, the dielectric constant becomes higher to thereby decrease the resonance frequency. In this case, since the area within the region also becomes smaller in accordance with the outside shape of the dielectric substrate, the area of the patch electrode becomes smaller, whereby the resonance frequency increases. On the other hand, when the outside shape of the dielectric substrate after calcination is large, the dielectric constant decreases to thereby increase the resonance frequency, but since the area within the region becomes larger, the area of the patch electrode also becomes larger to thereby decrease the resonance frequency. Therefore, a fluctuation in the resonance frequency associated with variations in the dielectric constant and a fluctuation in the resonance frequency associated with variations in the area of the patch electrode offset each other, and a desired resonance frequency can be obtained with stability irrespective of the variations in dimension of the dielectric substrate after calcination.

In the above-described structure, if the difference in level is a concave groove continuously formed inside an outer edge of the dielectric substrate, when the patch electrode is thick-film printed within the region, it is possible to position a printing mask with the concave groove as a guide, thus improving the workability during printing.

DETAILED DESCRIPTION OF THE PREFERRED EMBODIMENTS

Figure 1:
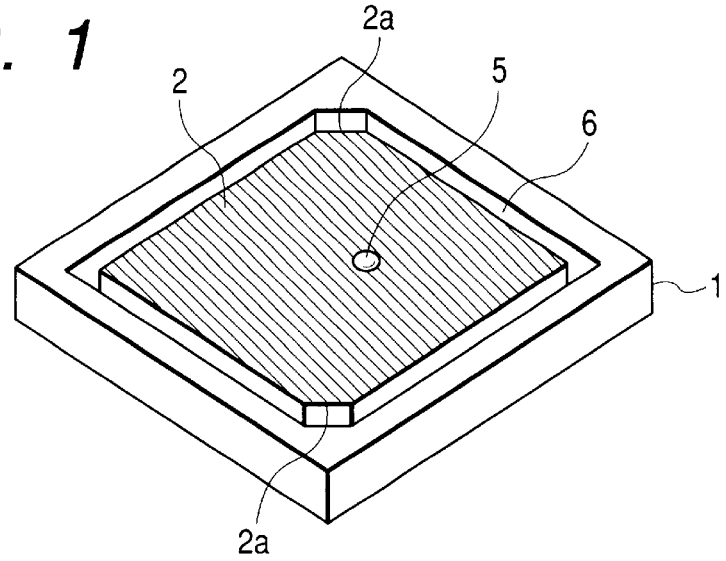
FIG. 1 is a perspective view showing a plane patch antenna according to an embodiment of the present invention.
Figure 2:
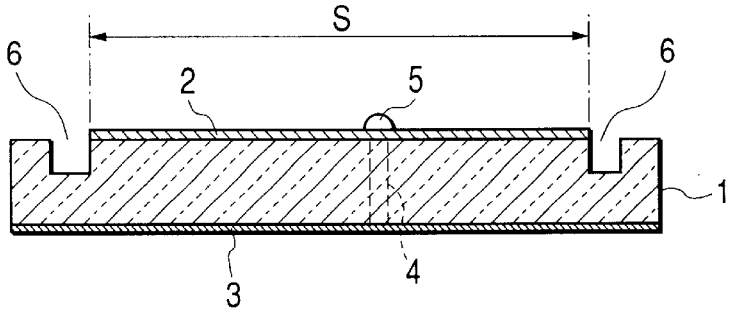
FIG. 2 is a cross-sectional view showing the plane patch antenna.

Hereinafter, with reference to the drawings, the description will be made of the embodiments of the invention. FIG. 1 is a perspective view showing a plane patch antenna according to an embodiment of the present invention, and FIG. 2 is a cross-sectional view showing the plane patch antenna.

As shown in these drawings, a plane patch antenna according to the present embodiment has a square dielectric substrate 1 made of ceramic material, a patch electrode 2 thick-film printed on one surface of the dielectric substrate 1, a ground electrode 3 thick-film printed on the entire other surface of the dielectric substrate 1, and a coaxial cable 4 penetrating the dielectric substrate 1, and the structure is arranged such that power is supplied to a feeding point 5 formed in the location at some distance from the center of the patch electrode 2 from the ground electrode 3 through the coaxial cable 4.

On one surface of the dielectric substrate 1, a concave groove 6 is continuously formed along the inside of its outer edge, and the entire surface within a region S partitioned by this concave groove 6 is formed with the patch electrode 2. The dielectric substrate 1 is obtained by calcining, after press molded in a desired shape, ceramic powder at about 1300° C., and the concave groove 6 is formed at the same time when the ceramic powder is press molded.

The patch electrode 2 has a pair of cutouts 2*a*, which are degenerated separate elements, in corners opposite to each other, and is formed over the entire surface of a region S inside partitioned by the concave groove 6 of the dielectric substrate 1. Namely, a visible outline of the patch electrode 2 and an inside edge line of the concave groove 6 coincide with each other. This patch electrode 2 is formed of a conductive layer of Ag or the like thick-film printed on the dielectric substrate 1 after calcination, and concretely, is formed by forming Ag paste by means of screen printing within the region S partitioned by the concave groove 6 of the dielectric substrate 1 after calcination to calcine this Ag paste at about 800° C.

Figure 3:
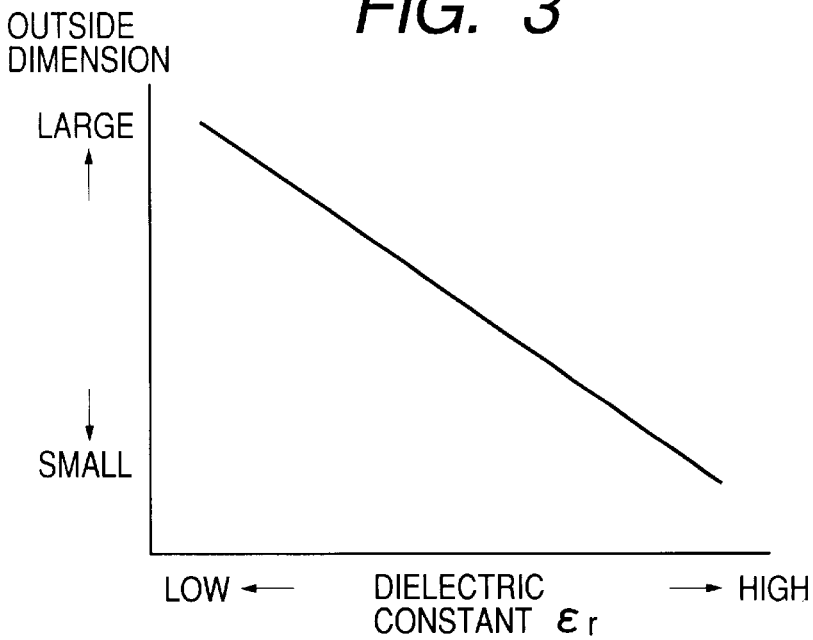
FIG. 3 is an explanatory view showing the relationship between an outside shape and a dielectric constant of a dielectric substrate after calcination of the plane patch antenna.

In the plane patch antenna structured as described above, the size of the dielectric substrate 1 after calcination varies with conditions of calcination and coupling among ceramic powder, which is the material, and since the degree of shrinkage is increased as the particle diameter of the ceramic powder is smaller and the calcination and coupling become closer, the outside shape of the dielectric substrate 1 becomes smaller and the dielectric constant becomes higher. In other words, as shown in FIG. 3, the outside dimension and the dielectric constant of the dielectric substrate 1 after calcination are in inverse proportion. When the outside dimension becomes smaller, the dielectric constant becomes higher, and when the outside dimension becomes larger, the dielectric constant becomes lower. Also, the patch electrode 2 is to be formed over the entire surface within the region S partitioned by the concave groove 6 of the dielectric substrate 1 after calcination, and since the area of this region S varies with the outside dimension of the dielectric substrate 1 after calcination, when the outside dimension of the dielectric substrate 1 after calcination is small, the area of the patch electrode 2 to be formed within the region S also becomes small, and on the other hand, when the outside dimension of the dielectric substrate 1 after calcination is large, the area of the patch electrode 2 to be formed within the region S also becomes large.

Figure 7:
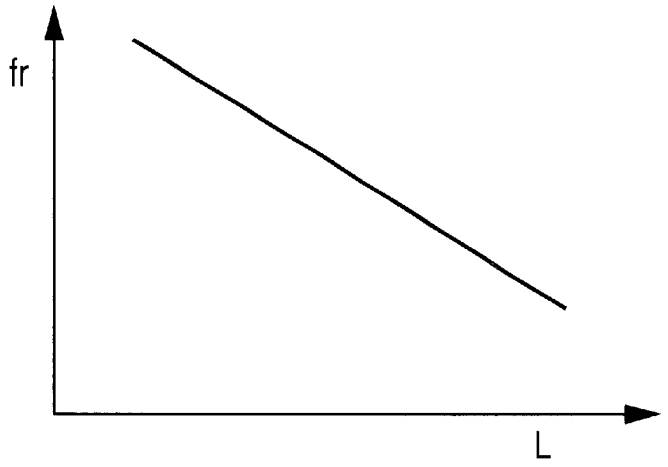
FIG. 7 PRIOR ART
FIG. 7 is an explanatory view showing relationship between length of one side of the patch electrode and a resonance frequency.
Figure 8:
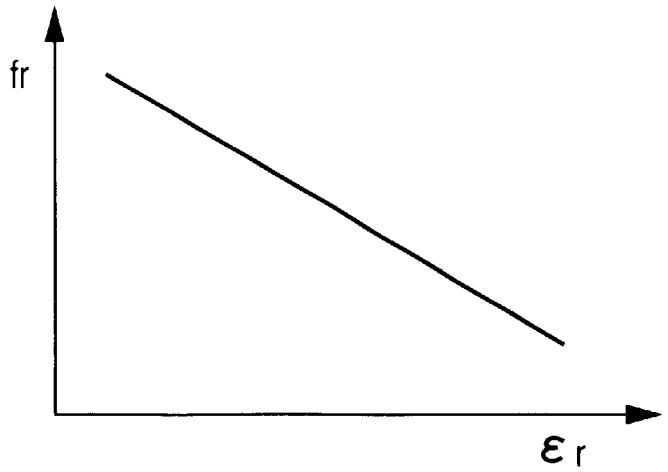
FIG. 8 PRIOR ART
FIG. 8 is an explanatory view showing the relationship between a dielectric constant of the dielectric substrate and a resonance frequency.

On the other hand, as described already, when length L (area) of one side of the patch electrode 2 becomes larger, the resonance frequency fr decreases (See FIG. 7), and when the dielectric constant $\epsilon r$ of the dielectric substrate 1 becomes higher, the resonance frequency fr decreases (See FIG. 8). Therefore, when the outside dimension of the dielectric substrate 1 after calcination is small, a decrease of the resonance frequency fr caused by the dielectric constant $\epsilon r$ becoming higher and an increase of the resonance frequency fr caused by the area of the patch electrode 2 becoming smaller offset each other, and a desired resonance frequency fr can be obtained with stability. On the other hand, when the outside dimension of the dielectric substrate 1 after calcination is large, an increase of the resonance frequency fr caused by the dielectric constant $\epsilon r$ becoming lower and a decrease of the resonance frequency fr caused by the area of the patch electrode 2 becoming larger offset each other, and a desired resonance frequency fr can also be obtained with stability in this case.

In the plane patch antenna according to the above-described embodiment, since the patch electrode 2 has been thick-film printed over the entire surface of the inside region S partitioned by the concave groove 6 of the dielectric substrate 1, the precision of the patch electrode 2 during thick-film printing becomes excellent depending upon the processing precision of the concave groove 6, and yet, a fluctuation in the resonance frequency fr associated with variations in the dielectric constant $\epsilon r$ and a fluctuation in the resonance frequency fr associated with variations in the area of the patch electrode 2 offset each other, and therefore, a desired resonance frequency fr can be obtained with stability irrespective of the variations in dimension of the dielectric substrate 1 after calcination, and a troublesome frequency adjusting operation can be saved. In addition, since a print formation plane of the patch electrode 2 is partitioned by the concave groove 6 continuously extending at a predetermined width, when the patch electrode 2 is thick-film printed, it is possible to position a printing mask with the concave groove 6 as a guide, thus making it possible to enhance the workability during printing.

Figure 4:
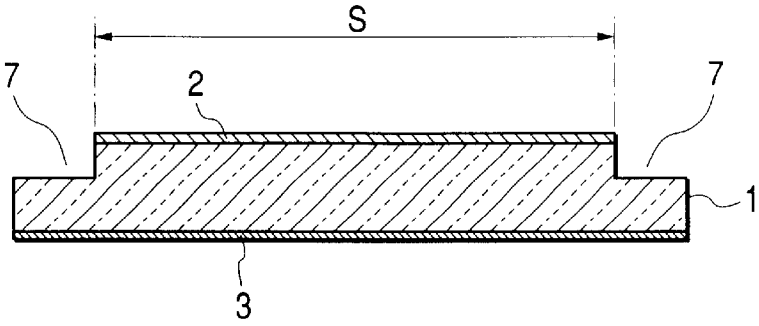
FIG. 4 is a cross-sectional view showing a plane patch antenna according to another embodiment.
Figure 5:
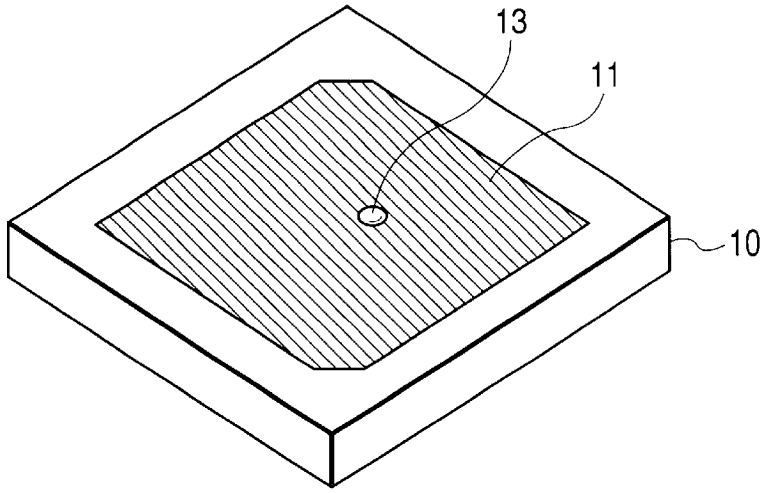
FIG. 5 PRIOR ART
FIG. 5 is a perspective view showing a plane patch antenna according to a prior art.
Figure 6:
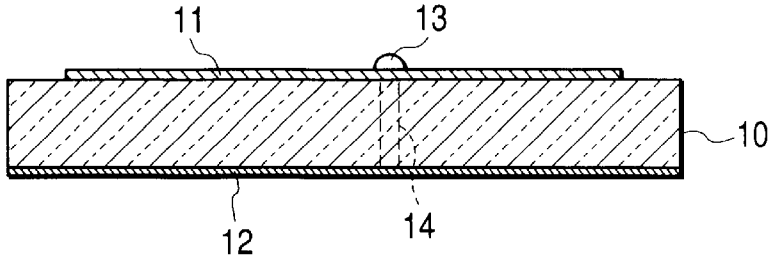
FIG. 6 PRIOR ART
FIG. 6 is a cross-sectional view showing the plane patch antenna.

In this respect, in the above-described embodiment, the description has been made of a case where in somewhat inside from the outer edge of the dielectric substrate 1, there is continuously formed the concave groove 6 and a region S, which is a print formation plane of the patch electrode 2, is partitioned by this concave groove 6, but it is also possible to form the step 7, as shown in FIG. 4, on one surface of the dielectric substrate 1 continuously from its outer edge and to use the region S partitioned by the inner edge line of this step 7 as the print formation plane of the patch electrode 2.

Also, in the above-described embodiment, the description has been made of the plane patch antenna having a substantially square patch electrode 2, but the present invention is also applicable to a plane patch antenna having a substantially circular patch electrode.

The present invention is carried out in such patterns as explained above to exhibit such effects as described below.

Since on one surface of the dielectric substrate, there is formed a region partitioned through its outer edge and a difference in level and on the entire surface of this region, the patch electrode has been thick-film printed, the precision of the patch electrode during thick-film printing becomes excellent and yet, the fluctuation in the resonance frequency associated with variations in the dielectric constant and the fluctuation in the resonance frequency associated with variations in the area of the patch electrode offset each other, and therefore, a desired resonance frequency can be obtained with stability irrespective of the variations in dimension of the dielectric substrate after calcination.

What is claimed is:

1. A plane patch antenna comprising:

a dielectric substrate having a first portion of a first thickness that is completely surrounded by a second portion of a second thickness, the second portion defined by a groove;

a patch antenna formed on a surface of the first portion; and a ground electrode formed on a surface opposing the patch antenna.

2. The plane patch antenna of claim 1, the patch antenna formed on an entirety of the surface of the first portion.

3. The plane patch antenna of claim 1, the ground electrode larger than patch antenna.

4. The plane patch antenna of claim 1, the second portion extending from an outer edge of the first portion to an outer edge of the dielectric substrate.

5. The plane patch antenna of claim 4, the patch antenna formed on an entirety of the surface of the first portion.

6. The plane patch antenna of claim 1, the first portion formed from a calcined ceramic powder and the patch antenna formed from a calcined metallic paste.

7. The plane patch antenna of claim 1, a surface of the dielectric substrate extending from an outer edge of the first portion to an end of the second portion exposed.

8. The plane patch antenna of claim 1, the first and second portions consisting of a single layer of dielectric material.

9. The plane patch antenna of claim 1, the patch antenna formed only on an entirety of the surface of the first portion.

10. The plane patch antenna of claim 1, the patch antenna consisting of conductive material formed on an entirety of the surface of the first portion.

11. The plane patch antenna of claim 1, a surface of the dielectric substrate extending from an outer edge of the first portion to an end of the second portion exposed.

12. The plane patch antenna of claim 1, the first and second portions consisting of a single layer of dielectric material.

13. The plane patch antenna of claim 1, the patch antenna formed only on an entirety of the surface of the first portion.

14. The plane patch antenna of claim 1, the patch antenna consisting of conductive material formed on an entirety of the surface of the first portion.

15. A plane patch antenna comprising:

a dielectric substrate having a first portion of a first thickness that is completely surrounded by a second portion of a second thickness, the second portion defined by a groove;

a patch antenna formed on a surface of the first portion; and a ground electrode formed on an entirety of a surface opposing the patch antenna.

16. The plane patch antenna of claim 15, the patch antenna formed on an entirety of the surface of the first portion.

17. The plane patch antenna of claim 15, the ground electrode larger than patch antenna.

18. The plane patch antenna of claim 15, the groove being continuously formed around the first portion.

19. The plane patch antenna of claim 15, the second portion extending from an outer edge of the first portion to an outer edge of the dielectric substrate.

20. The plane patch antenna of claim 19, the second portion continuously formed around the first portion.

21. The plane patch antenna of claim 19, the patch antenna formed on an entirety of the surface of the first portion.

22. The plane patch antenna of claim 1, the first portion formed from a calcined ceramic powder and the patch antenna formed from a calcined metallic paste.

* * * * *